United States Patent [19]

Yoshida

[11] 3,976,292

[45] Aug. 24, 1976

[54] SUCTION SHAFTS FOR A PAPER COUNTING APPARATUS

[75] Inventor: Minoru Yoshida, Tokyo, Japan

[73] Assignee: Laurel Bank Machine Co., Ltd., Tokyo, Japan

[22] Filed: Mar. 19, 1975

[21] Appl. No.: 559,874

[52] U.S. Cl. ..... 271/95; 235/92 SB

[51] Int. Cl.[2] ..... B65H 3/42

[58] Field of Search ..... 271/95; 235/92 SB

[56] References Cited

UNITED STATES PATENTS

| | | | |
|---|---|---|---|
| 3,597,594 | 8/1971 | Evans | 271/95 |
| 3,720,409 | 3/1973 | Kubo et al. | 271/95 |
| 3,795,796 | 3/1974 | Shigemori | 271/95 |

*Primary Examiner*—Evon C. Blunk
*Assistant Examiner*—Robert Saifer
*Attorney, Agent, or Firm*—Haseltine, Lake & Waters

[57] ABSTRACT

A plurality of suction shafts are rotatably mounted in a rotatable cylinder which is driven counter-clockwise. Each of the suction shafts is rotatably driven clockwise and is provided with a curved suction surface having its axis of curvature in a plane perpendicular to the rotational axis thereof. Openings are formed in the curved suction surfaces for communicating a vacuum pump through the interiors of the suction shafts with the atmosphere.

2 Claims, 5 Drawing Figures

SUCTION SHAFTS FOR A PAPER COUNTING APPARATUS

This invention relates to an apparatus for counting the number of thin paper sheets such as various kinds of slips, tickets and the like and more particularly, to suction shafts for turning over the paper sheets one by one utilizing vacuum assistance.

Such a conventional apparatus known hereto in this field has been designed for the purpose of counting the number of notes and includes a plurality of circumferentially spaced suction shafts 2 rotatably mounted in a rotatable cylinder 1 which is adapted to be driven counter-clockwise, the suction shafts being also rotatably driven clockwise around their axes (see FIG. 1 of the drawing). Each of the suction shafts 2 has a curved suction surface 3 formed thereon in which an opening 4 is formed for communicating a vacuum pump (not shown) through the interior of the shaft with the atmosphere. A holder 7 is disposed adjacent the rotatable cylinder 1 and is provided with a guide plate 8 against which a bundle of papers 5 sealed by a band 6 is held by a rod 9 which is mounted on a spring-loaded lever 9' pivoted to the holder 7 at 10. The holder 7 is urged toward the rotatable cylinder 1 around the pivot 10 under the action of a spring (not shown) to move the bundle of papers toward the rotatable cylinder 1.

When the suction surface 3 on one of the suction shafts faces the foremost paper 5 of the bundle of papers, suction is applied from the vacuum pump (not shown) through the opening 4 to the foremost paper 5 to draw it against the suction surface 3. After the rotatable cylinder 1 and the suction shafts have been rotated predetermined angles from a position as shown in FIG. 1, respectively, as indicated by arrows in the drawings, the paper 5 is released from the suction on the curved suction surface 3 so that it will be positioned between its associated shaft and the subsequent one. It should be understood that during the suction of the paper onto the suction shaft, a counting operation is carried out by means of a known mechanism.

It will be noted that the suction surface 3 has its axis of curvature i.e. its center of curvature, in a plane parallel to the axis of the suction shaft. Thus, during rotation of the its associated shaft, the paper sucked on the curved suction surface 3 is folded along the edge 2' of the surface 3 parallel to the axis of the suction shaft. If the adjacent two papers have been sucked on the suction surface on the suction shaft under the action of suction through the opening 4, they may be folded together making it impossible to separate them from each other. Particularly, thinner papers which tend to be sucked two at a time have less folding resistances, so that separation of the two folded papers from each other is not obtained. This gives rise to a problem of incorrect count of the number of the papers.

The present invention seeks to eliminate the disadvantage as set forth above by providing suction shafts having curved suction surfaces as will be described hereafter in detail.

A main object of the invention is to provide suction shafts each having a curved suction surface thereon which makes it possible to separate two papers from each other when they have been sucked together on the curved suction surface.

Another object of the invention is to provide suction shafts wherein each of said curved suction surfaces has its center of curvature in a plane perpendicular to the axis of the suction shaft to offer a great folding resistance to two papers sucked on the curved suction surface as the suction shaft is rotated.

Other objects and advantages of the invention will be apparent from the following description taken in conjunction with the accompanying drawing.

Figure 1:
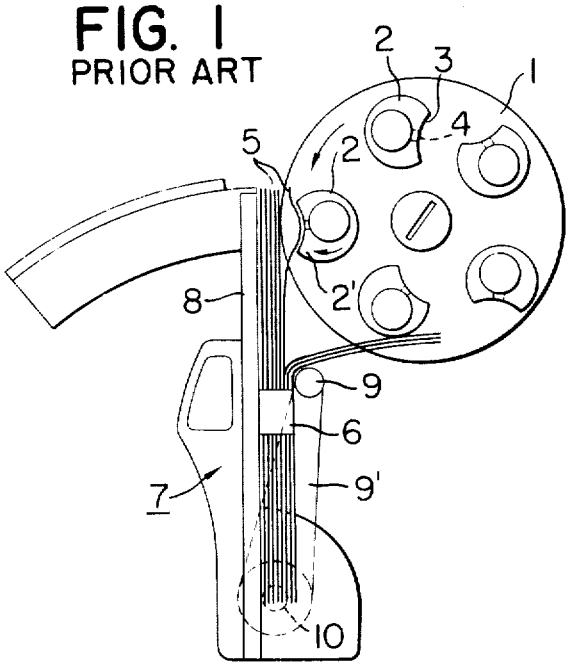
FIG. 1 PRIOR ART
FIG. 1 is a top plan view of a portion of a conventional counting apparatus.
Figure 2:
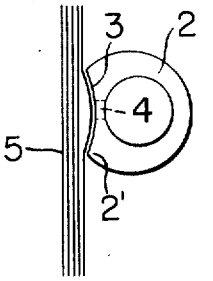
FIG. 2 PRIOR ART
FIG. 2 is an enlarged top plan view of one of suction shafts used for the apparatus shown in FIG. 1.

It should be understood that suction shafts constructed in accordance with the present invention are used with a rotatable cylinder 1 as shown in FIG. 1 of the drawing.

Figure 3:
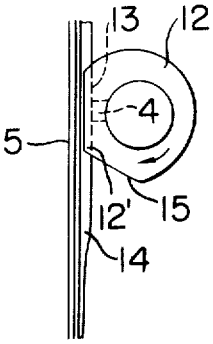
FIG. 3 is a view similar to FIG. 2, but showing a suction shaft constructed in accordance with the present invention.
Figure 4:
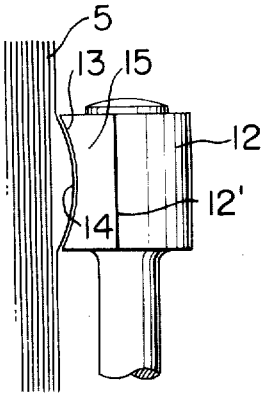
FIG. 4 is a side elevational view of the suction shaft shown in FIG. 3.
Figure 5:
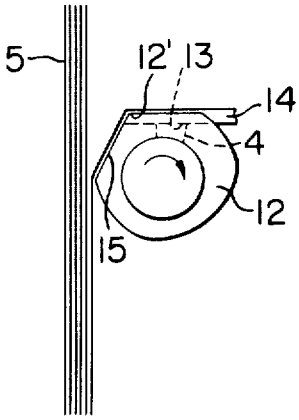
FIG. 5 is a view similar to FIG. 3, but showing the suction shaft rotated clockwise from its position as shown in FIG. 3.

Referring to FIGS. 3, 4 and 5 of the drawing, each of suction shafts 12 is provided with a curved suction surface 13 having its center of curvature in a plane perpendicular to the axis of rotation of shaft 12 and shaft 12 has an opening 4 formed in the curved suction surface 13 for communicating a vacuum pump, through the interior of the shaft 12, with the atmosphere. A flat surface 15 is formed on the suction shaft 12 at an angle to the curved suction surface 13 to intersect the curved suction surface at its tail or trailing edge 12'.

It will be understood that when suction is applied through the opening 4 to the foremost paper 5 of a bundle of papers to draw it against the curved suction surface 13 on the suction shaft 12, the sucked paper 5 will be curved longitudinally thereof as shown at 14 in the drawing. Then, the paper 5 is folded by the tail edge 12' of the suction surface 13 in a direction perpendicular to the center of curvature thereof as the suction shaft 12 is rotated clockwise. It will be anticipated that the paper 5 has a great folding resistance during the folding operation. Therefore, even if two adjacent papers have been sucked on the suction surface on the suction shaft, one of them to which less suction has been applied will be separated from the other paper sucked directly on the suction surface due to the great folding resistance during the folding operation.

As the suction shaft 12 continues to be rotated clockwise, the flat surface 15 on the suction shaft flattens the curved portion of the paper which meets the flat surface. This will be furthermore helpful to separate the sucked two papers from each other.

What is claimed is:

1. Suction shafts used for a paper counting apparatus wherein each of the suction shafts is rotatably mounted in a rotatable cylinder driven counterclockwise and is provided with a curved suction surface having a center of curvature in a plane perpendicular to the axis of rotation of the suction shaft, said suction shafts being rotatably driven clockwise and each provided with an opening extending to the suction surface for communicating with the interior of the suction shaft to apply suction to the foremost paper of a bundle of papers facing the suction surface, the sucked paper being curved longitudinally thereof and folded by a trailing edge of the suction surface in a direction perpendicular to the center of curvature thereof as the suction shaft is rotated clockwise.

2. Suction shafts claimed in claim 1, wherein each shaft is provided with a flat surface intersecting the curved suction surface at said trailing edge.

* * * * *